United States Patent [19]

Rice

[11] Patent Number: 4,924,971

[45] Date of Patent: May 15, 1990

[54] LADDER SAFETY APPARATUS

[76] Inventor: Billy M. Rice, 12741 Woodland Dr., Longmont, Colo. 80501

[21] Appl. No.: 349,563

[22] Filed: May 9, 1989

[51] Int. Cl.[5] ..... E06C 1/34; E06C 5/36; E06C 7/48

[52] U.S. Cl. ..... 182/93; 182/107

[58] Field of Search ..... 182/107, 108, 229, 93; 248/210

[56] References Cited

U.S. PATENT DOCUMENTS

| | | | |
|---|---|---|---|
| 2,999,290 | 9/1961 | Giles | 182/107 |
| 3,037,579 | 6/1962 | Barrow | 182/107 |
| 3,903,991 | 9/1975 | Phelan | 182/93 |
| 4,792,016 | 12/1988 | Ingalsbe | 182/107 |

*Primary Examiner*—Reinaldo P. Machado
*Attorney, Agent, or Firm*—Francis A. Sirr; Earl C. Hancock

[57] ABSTRACT

A ladder safety apparatus for use with a straight ladder having vertical side rails, and having horizontally aligned openings in the side rails, is disclosed. An example is a hollow-rung metal or aluminum ladder. The safety apparatus includes a flexible metal cable of a length somewhat greater than the rail-to-rail dimension of the ladder, the cable extending through the openings in the side rails. An elongated metal bolt or tube is non-removably attached to each end of the metal cable, to thereby form a linear extension of the metal cable. First and second building attachment means are provided, each such means having a metallic cable-attachment portion with an opening therein whereby the building attachment means is slidably and loosely mounted on the bolt or tube. An adjustment nut or collet is mounted on the bolt or tube, and in a position to adjustably trap the cable-attachment portion on an end of the metal cable. The metal cable includes a protective plastic covering.

21 Claims, 2 Drawing Sheets

LADDER SAFETY APPARATUS

FIELD OF THE INVENTION

This invention pertains to the field of ladders, scaffolds, and the like, and more particularly to safety apparatus for use with a ground supported ladder or scaffold.

BACKGROUND OF THE INVENTION

The present invention provides a solution for the well known problem of stabilizing the position of a straight ladder, or extension ladder, as the ladder is vertically positioned for use such as resting against the side of a building.

Various means are provided in the prior art addressing this problem. For example U.S. Pat. No. 1,374,060 suggests the use of a U-shaped member to encircle the side vertical rail of a ladder, the U-shaped member having downturned tines that are adapted to engage the gutter of a building. U.S. Pat. No. 3,853,202 also describes a device of this general type. U.S. Pat. No. 3,268,196 provides a safety lock for a ladder by the use of a clamp that generally encircles the two vertical rails of a ladder, and that includes a second clamp for attachment to the gutter of a building. In U.S. Pat. No. 3,603,431 a ladder is provided with a pair of pivoted support arms that are mounted at the upper end of the ladder side rails. Each of these support arms includes a clamp assembly having a sharpened end portion that is adapted to bite into the overhanging roof structure of a building.

While the devices of the prior art, of which the foregoing are illustrative examples, are generally useful for their intended purpose, they either require placement on the ladder after the ladder is positioned against the building, as in the case in U.S. Pat. No. 1,374,060, or they interfere with placement of the ladder against the building, as in the case of U.S. Pat. No. 3,853,202 for example.

There remains a need in the art for a ladder safety apparatus that is of a small, compact size, to thereby facilitate merchandising, shipment, storage, etc. There is also a need for a ladder safety apparatus that one can attach to the ladder prior to erection of the ladder, which apparatus can remain attached to the ladder during subsequent ladder storage, etc., or which apparatus is removable from the ladder after use, as is desired by the operator. There is an additional need in the art for a ladder safety device that is attachable to a ladder prior to erection of the ladder, and yet in a manner such that the apparatus does not interfere with placement of the ladder for use against a building or the like.

The present invention provides a new and unusual construction and arrangement for a ladder safety apparatus that satisfies these needs, and provides other features and advantages, as is apparent to those of skill in the art upon reference to the following description of the invention.

SUMMARY OF THE INVENTION

The present invention relates to a ladder safety apparatus for use with a generally straight ladder having vertical side rails, and having horizontally aligned openings formed in the side rails, is disclosed. An example of such a ladder is the well known contemporary hollow-rung metal extension ladder, such as an aluminum extension ladder. However, the spirit, scope and application of the invention is not limited to these well known ladder constructions.

The safety apparatus includes a flexible cable of a length somewhat greater than the rail-to-rail dimension of the ladder. This cable encircles the ladder, or preferably extends through the openings in the side rails, and preferably through a hollow rung near the top of the ladder, for example one of the first three rungs from the top of the ladder, or from the top of the ladder top extension.

An elongated bolt in one embodiment of the invention, or a tube in a second embodiment, is non-removably attached or otherwise secured to each end of the cable, to thereby form a linear extension of the cable. First and second building attachment hooks are provided, each such hook having a cable-attachment portion with an opening therein whereby the hook is slidably and loosely mounted on the bolt, or on the tube.

An adjustment nut in the first embodiment, or an adjustable collet in the second embodiment, is mounted on the bolt or on the tube, so as to adjustably trap the cable-attachment portion of the hook at an end of the cable.

The building hook of the preferred embodiments of the invention is adapted to hook onto the gutter of a building such as a domestic residence, and as such it has great utility. However, the present invention is not limited thereto since those skilled in the art will readily visualize other building attachment means within the scope and content of the invention.

These hook-like building attachment means are movable along the above mentioned bolt or tube, to thereby facilitate adjustment of the effective length of the ladder safety apparatus, as the cable thereof extends through the openings in the ladder side rails, and as the building attachment means thereof secures the two ends of the cable to a building or the like.

An object of the invention is to provide a ladder safety apparatus that is of a compact size, so as to facilitate storage, packaging, marketing and the like. For example, in preferred embodiments of the invention the apparatus comprises a cable that can be tightly coiled for packaging, etc, and that includes rigid bolts or tubes only about 6 inches in length.

A further object of the invention is to provide a ladder safety apparatus for use in stabilizing the position of a straight ladder as it leans against a building or the like, the apparatus comprising, a flexible cable of a length somewhat greater than the rail-to-rail dimension of the ladder, first and second cable ends members or terminals attached one to each end of the cable, and first and second building attachment means movably attached to the first and second terminals, respectively, to thereby facilitate adjustment of the effective length of the ladder safety apparatus as the cable encircles the ladder or penetrates the ladder, and as the building attachment means secures the two ends of the cable to a building or the like.

The invention has particular utility when used with a ladder having horizontally aligned openings in the side rails of the ladder, and wherein the cable is of a diameter somewhat less than the diameter of the openings in the ladder side rails, and extends through these side rail openings.

In preferred embodiments of the invention, the cable is a flexible metal cable, having an elongated metal bolt or an elongated hollow metal tube non-removably attached to each end of the metal cable, the bolt or tube forming a linear extension of the metal cable, and each of a first and second building attachment means includes a metallic cable-attachment portion with an opening therein whereby the building attachment means is slidably and loosely mounted on the bolt or tube, and an adjustment nut or collet mounted on the bolt or tube in a position to adjustably trap the cable-attachment portion an end of the metal cable.

In the preferred embodiments of the invention, the metal cable is in the range of about 18 to 20 inches long and is about ⅛ inch in diameter, and bolt or tube cable terminal portions are in the range of about 6 inches long and about ¼ inch in diameter.

Those having normal skill in the art will recognize the foregoing and other objects, features, advantages and applications of the present invention from the following more detailed description of the preferred embodiments as illustrated in the accompanying drawings.

DETAILED DESCRIPTION OF THE INVENTION

The present invention is herein described with reference to a conventional metal straight ladder having hollow rungs or steps. An exemplary ladder is the well known aluminum extension ladder of the type found in most domestic household garages.

Figure 1:
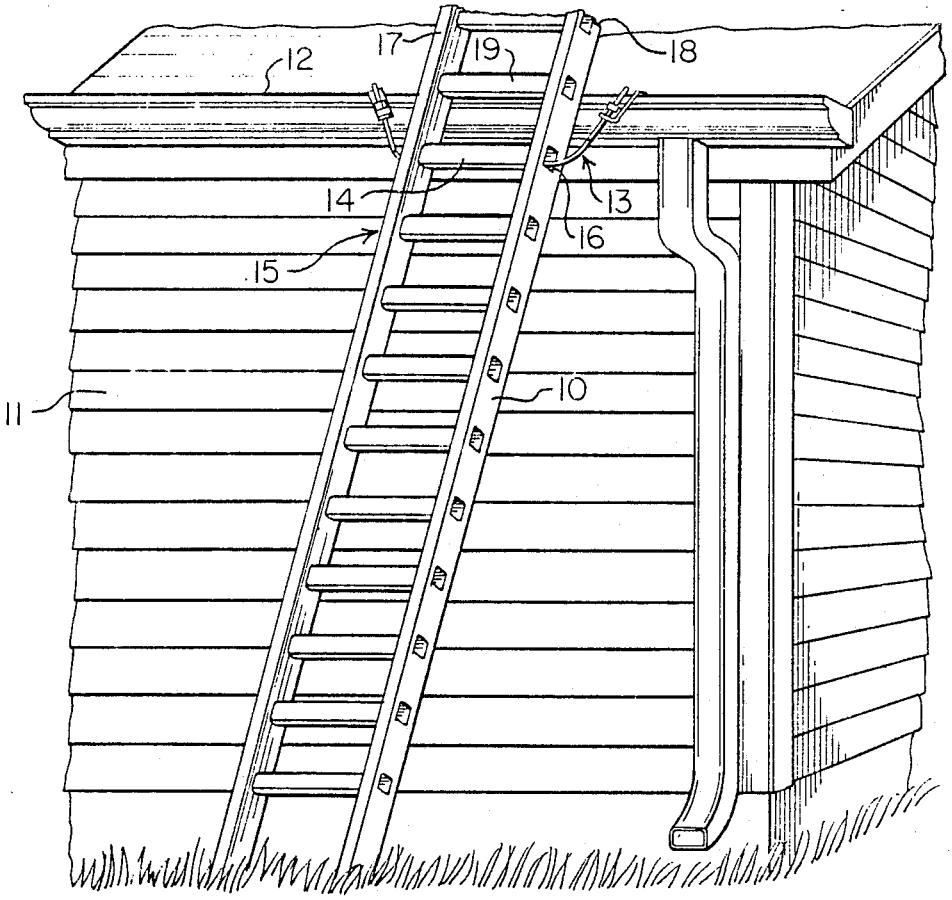
FIG. 1 shows the combination of a ladder and the ladder safety apparatus of the invention, and shows the ladder as it leans against the side of a building and is secured to the gutter of the building.

The more unskilled the laborer, the more likely accidents are to occur when using a ladder of this type. FIG. 1 shows such a straight ladder 10 in operative position, leaning against the side of a building 11, and extending above the roof or gutter line 12 of building 11. While building 11 is shown as a one story building, the risks to the user are even greater when the building is a multi-story building.

As personal experience will testify, ladder 10 is subject to forces causing side tipping, as well as tipping away from building 11, as the effective center of gravity is shifted outside of the support area defined by the feet of the ladder and the object it is leaning against. For example, when an individual carries a load up the ladder, and dismounts the ladder to the side or over the top rung, the force exerted between the ladder and the building roof can easily cause the ladder to move and at least begin to tip. This effect is also noted when the individual subsequently mounts the ladder from the roof. In addition, and especially when the ladder is extended for a multi-story building, wind can provide a tipping force against the ladder. All of these effects make it desirable to provide a ladder safety apparatus to stabilize the position of ladder 10 against building 11.

The present invention as shown at 13 in FIG. 1 comprises a flexible metal cable that extends through the hollow rung 14 which is third from the top of ladder 10. This cable thus extends through horizontally aligned openings 15 and 16 in the side rails 17 and 18 of the ladder. The two ends of this cable terminate in length-adjustable terminal means that attach to gutter line 12. Note that, in the application example shown in FIG. 1, the cable could have passed through other rungs including second rung 19. While the present invention is described with reference to attachment to a domestic building having metal rain gutters, it is expected that, within the scope and spirit of this invention, those skilled in the art will originate other cable terminal means for attachment to other portions or elements associated with buildings against which ladder 10 is placed.

Figure 2:
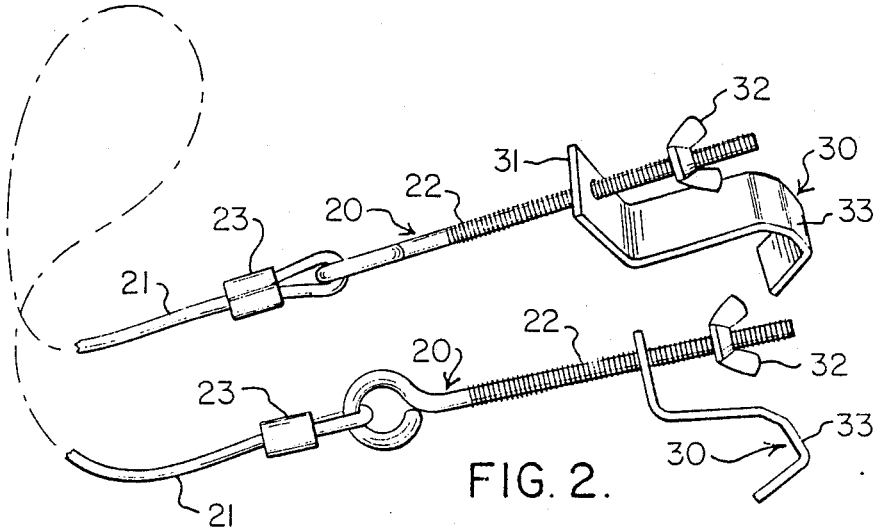
FIG. 2 shows a first embodiment of the invention.

FIG. 2 shows a first embodiment of the invention wherein the length-adjustable terminal means at each end of a flexible metal cable 21 comprises a bolt, and more specifically an eye-bolt 20. In a preferred embodiment, but without limitation thereto, cable 21 comprised a plastic covered, six-strand steel cable about ⅛ inch in diameter and from about 18 to about 20 inches in length. In a more generic sense, cable 21 is of a length somewhat greater than the rail-to-rail dimension of ladder 10, and cable 21 is of a diameter somewhat less than the diameter of the openings 15 and 16 that are formed in ladder side rails 17 and 18. The cable terminal ends are either removable, to enable insertion of the cable through openings 15 and/or 16, or preferably the terminal ends are themselves small, and enable the threading of the cable through these openings without disassembly of the apparatus of the invention.

Within the teachings of the invention, these cable terminal ends are of an adjustable length, to thereby facilitate adjustment of the effective length of the ladder safety apparatus of the invention, as the cable thereof either encircles the ladder, or extends through openings in the side rails thereof, and as the terminal ends of the cable secure the safety apparatus and the ladder to a building or the like.

In FIG. 2, the two cable terminals each comprise an elongated metal bolt means in the form of an eye-bolt 20 that is securely attached to an end of metal cable 21. Each bolt 21 includes a threaded portion 22 that forms a linear extension of cable 21. In this embodiment, the eye portion of each bolt 20 is secured with a non-removable attachment to one end of cable 21 by passing an end of said cable through the eye portion in the bolt, and then securing the cable end to an adjacent portion of the cable by the use of a deformable metal cable clamp 23. In on exemplary construction of the FIG. 2 preferred embodiment, metal bolts 20 were six inches long and ¼ inch in diameter.

The means by which the ladder safety apparatus of the invention is secured to gutter 12 comprises, without limitation thereto, first and second building attachment means or hooks 30. Each hook 30 includes a metallic cable-attachment portion 31 that includes a hole or opening therein whereby hook 30 is slidably and loosely mounted on the threaded portion 22 of one of the bolts 20. In the aforementioned exemplary construction of a device in accordance with the FIG. 2 preferred embodiment of the invention, member 30 was formed of strap metal 4¼ inch long, ¾ inch wide and 3/32 inch thick. Member 30 was also plastic covered to protect gutter 12.

Figure 3:
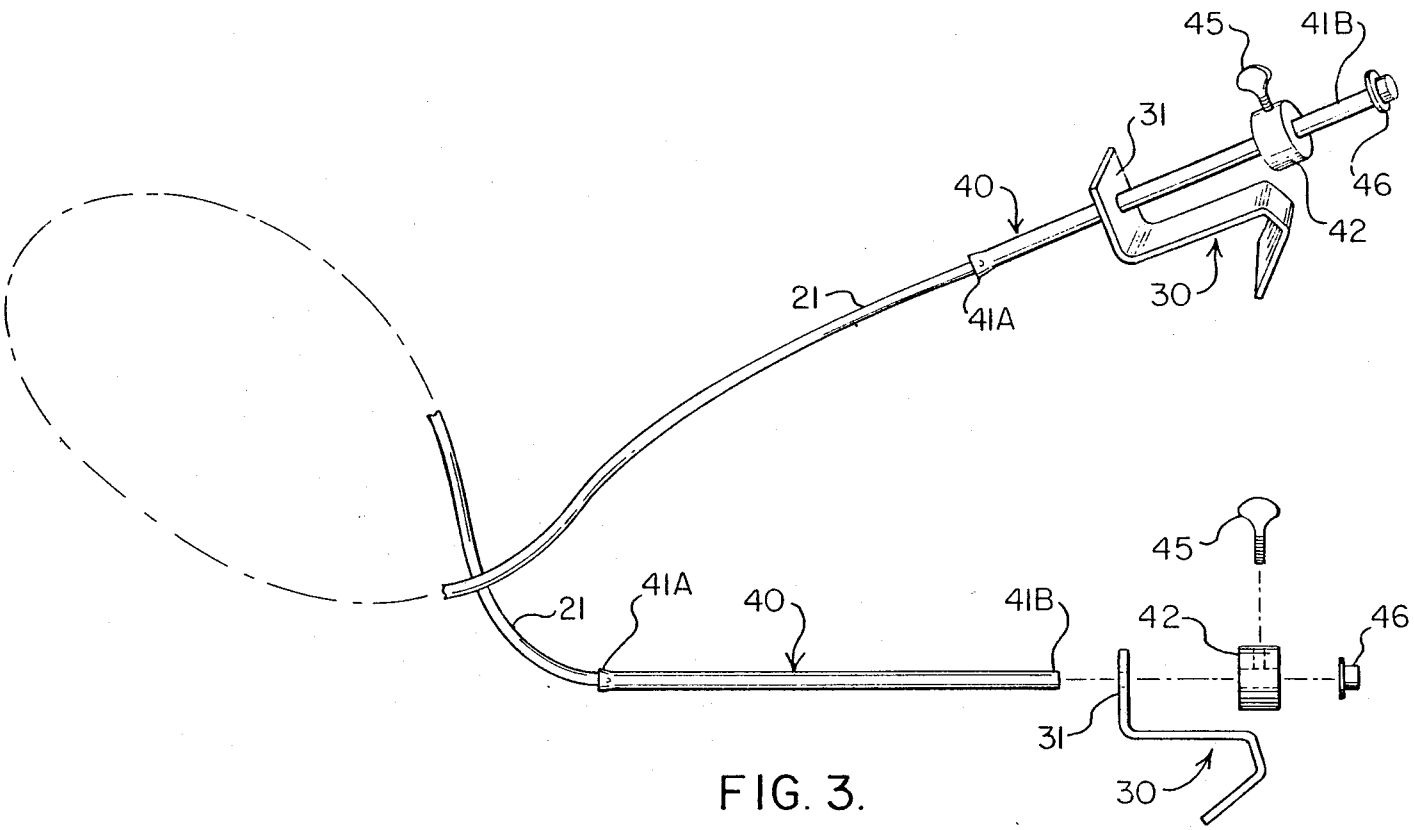
FIG. 3 shows a second embodiment of the invention.

As illustrated in both FIGS. 2 and 3, member 30 includes a hook portion 33 that is adapted to removably attach the ladder safety apparatus to any suitable element of the object against which ladder 10 is placed such as the rain gutter 12 of a building or the like.

The threaded portion of each bolt 20 includes an adjustment nut, such as wing nut 32, that is mounted on the threaded portion 22 of each bolt 20, in a position to adjustably trap the cable-attachment portion of an end of cable 21. Thus the adjustable position of nut 32 on threaded portion 22 determines the effective length of cable 21.

FIG. 3 discloses a second embodiment of the invention where the cable end terminal means comprise an elongated, uniform diameter, hollow metal tube 40 having one end 41 thereof non-removably attached to one end of metal cable 12. Each of the tubes 40 includes a barrel establishing a major-length portion 41 thereof that forms a linear extension of cable 21.

In this embodiment, the two hooks 30 by which the safety apparatus is attached to a building are as above described in that a portion 31 thereof is slidably and loosely mounted on the major portion of tube 40.

The adjustment function of this embodiment is provided by a sliding collet 42 made of plastic or nylon, for instance, that is adjustably mounted on the major portion of the tube, in a position to adjustably trap portion 31 of hook 30 between an end of cable 21 and the adjustable position of collet 42 on the major portion 41 of tube 40. A thumb screw 45 provides a means for manually securing collet 42 to a desired position on the major portion of its tube 40. In a preferred embodiment of the FIG. 3 construction and arrangement, each tube 40 was about six inches long, was closed at its extending end, and the tubes were formed of ¼ inch outer diameter tubing, having a 1/16 inch wall thickness. Each tube was non-removably attached to one end of metal cable 21 by passing an end of the cable into the end 41A of the tube, and then crimping the tube end down onto the cable end. Tubular shaped collets 42 were about ½ inch long and ¾ inch in diameter.

In this embodiment of the invention, it is likely that due to the size of the opening in the ladder side rails, for example the size of the holes in the ends of hollow rungs along the side rails 17 and 18, the user may prefer to remove collet 42 and hook member 30 from one end of the cable to facilitate the threading of the cable through the ladder openings. Since collets 42 and hook members 30 are removable in this manner, it may prove desirable to provide a retainer cup 46 at the extending end of each tube 40 to prevent accidental loss of these members.

As can be seen from the above description, the ladder safety apparatus of the present invention is of a small, compact size, and thereby facilitates merchandising, shipment, storage, etc. Also, the ladder safety apparatus of the present invention is constructed and arranged so that the apparatus can be attached to a ladder prior to erection of the ladder, and the apparatus can remain attached to the ladder during subsequent ladder storage, etc., or it can be removed from the ladder after use, as is desired by the user. In addition, the ladder safety device of the invention is attachable to a ladder prior to erection of the ladder, and yet the construction and arrangement of the ladder safety apparatus does not interfere with placement of the ladder against a building or the like.

The present invention has been described in detail above with reference to the illustrated preferred embodiments thereof. However, since the foregoing detailed description will suggest other embodiments of the invention to those skilled in the art, it is not intended that the foregoing description limit the spirit and scope of the invention.

What is claimed is:

1. Ladder safety apparatus for use in stabilizing the position of a generally straight ladder as the ladder leans against a building or the like, the apparatus comprising;

flexible cable means of a length somewhat greater than the rail-to-rail dimension of the ladder, first and second terminal means attached one to each end of said cable means, and first and second building attachment means movably attached to said first and second terminal means, respectively, to thereby facilitate adjustment of the effective length of said ladder safety apparatus as said cable means encircles the ladder, and as said first and second building attachment means secure the two ends of said cable means to a building or the like.

2. The ladder safety apparatus of claim 1 wherein the top portion of the ladder includes horizontally aligned openings that penetrate the side rails of the ladder, wherein said cable means is of a diameter somewhat less than the diameter of the openings in the ladder side rails, and wherein said first and second building attachment means are movable relative said first and second terminal means, respectively, to thereby facilitate adjustment of the effective length of said ladder safety apparatus as said cable means extends through the openings in the ladder side rails, and as said first and second building attachment means secure the two ends of said cable means to a building or the like.

3. The ladder safety apparatus of claim 2 wherein said cable means comprises a flexible metal cable, wherein each of said first and second terminal means comprises an elongated metal bolt non-removably attached to one end of said metal cable, each bolt having a threaded portion that forms a linear extension of said metal cable, and wherein each of said first and second building attachment means comprises (a) metallic cable-attachment portion having a opening therein whereby said building-attachment means is slidably and loosely mounted on the threaded portion of one of said bolts, and (b) an adjustment nut mounted on the threaded portion of said bolt in a position to adjustably trap said cable-attachment means portion an end of said metal cable and the adjustable position of said adjustment nut on said threaded portion.

4. The ladder safety apparatus of claim 3 wherein said metal cable includes a protective plastic covering, and wherein said first and second elongated metal bolts each comprise an eye-bolt that is non-removably attached to one end of said metal cable by passing an end of said cable through the eye in said eye-bolt and then securing said cable end to an adjacent portion of said cable by the use of a cable clamp.

5. The ladder safety apparatus of claim 4 wherein each of said building-attachment means includes a hook portion adapted to removably attach said ladder safety apparatus to the rain gutter of a building or the like.

6. The ladder safety apparatus of claim 5 wherein said metal cable is in the range of about 18 to 20 inches long and is about ⅛ inch in diameter, and wherein the threaded portion of each of said bolts is in the range of about 6 inches long and about ¼ inch in diameter.

7. The ladder safety apparatus of claim 2 wherein said cable means comprises a flexible metal cable, wherein each of said first and second terminal means comprises an elongated, uniform diameter, hollow metal tube having one end thereof non-removably attached to one end of said metal cable, each tube having a major portion thereof that forms a linear extension of said metal cable, and wherein each of said first and second building-attachment means comprises (a) a metallic portion having an opening therein whereby said building-attachment means is slidably and loosely mounted on the major portion of one of said tubes, (b) a sliding collet adjustably mounted on the major portion of said tube in a position to adjustably trap said building-attachment means between an end of said metal cable and the adjustable position of said collet on said major portion, and (c) means for manually securing said collet to a desired position on the major portion of said tube.

8. The ladder safety apparatus of claim 7 wherein said first and second elongated metal tubes are each non-removably attached to one end of said metal cable by passing an end of said cable into said tube and then crimping said tube down onto said cable end.

9. The ladder safety apparatus of claim 8 wherein each of said building-attachment means includes a hook adapted to removably attach said ladder safety apparatus to the rain gutter of a building or the like.

10. The ladder safety apparatus of claim 7 wherein said metal cable is in the range of about 18 to 20 inches long and is about ⅛ inch in diameter, wherein said metal cable includes a protective plastic covering, and wherein the metal tubes are in the range of about 6 inches long, and have about a ¼ inch outer diameter and about a 1/16 inch wall thickness.

11. In combination, a straight ladder having side rails and aligned openings in said side rails, flexible cable means of a length somewhat greater than the rail-to-rail dimension of said ladder, and extending through said openings in said side rails, first and second terminal means attached one to each end of said cable means, and first and second building attachment means movable attached to said first and second terminal means, respectively, to thereby facilitate adjustment of the effective length of said cable means as said first and second building attachment means secure the two ends of said cable means to a building or the like.

12. The combination of claim 10 wherein said cable means comprises a flexible metal cable, wherein each of said first and second terminal means comprises an elongated metal bolt non-removably attached to one end of said metal cable, each bolt having a threaded portion that forms a linear extension of said metal cable, and wherein each of said first and second building attachment means comprises (a) metallic cable-attachment portion having a opening therein whereby said building-attachment means is slidably and loosely mounted on the threaded portion of one of said bolts, and (b) an adjustment nut mounted on the threaded portion of said bolt in a position to adjustably trap said cable-attachment means portion an end of said metal cable and the adjustable position of said adjustment nut on said threaded portion.

13. The combination of claim 11 wherein said metal cable includes a protective plastic covering, and wherein said first and second elongated metal bolts each comprise an eye-bolt that is non-removably attached to one end of said metal cable by passing an end of said cable through the eye in said eye-bolt and then securing said cable end to an adjacent portion of said cable by the use of a cable clamp.

14. The combination of claim 12 wherein said metal cable is in the range of about 18 to 20 inches long and is about ⅛ inch in diameter, and wherein the threaded portion of each of said bolts is in the range of about 6 inches long and about ¼ inch in diameter.

15. The combination of claim 10 wherein said cable means comprises a flexible metal cable, wherein each of said first and second terminal means comprises an elongated, uniform diameter, hollow metal tube having one end thereof non-removably attached to one end of said metal cable, each tube having a major portion thereof that forms a linear extension of said metal cable, and wherein each of said first and second building-attachment means comprises (a) a metallic portion having an opening therein whereby said building-attachment means is slidably and loosely mounted on the major portion of one of said tubes, (b) a sliding collet adjustably mounted on the major portion of said tube in a position to adjustably trap said building-attachment means between an end of said metal cable and the adjustable position of said collet on said major portion, and (c) means for manually securing said collet to a desired position on the major portion of said tube.

16. The combination of claim 14 wherein said first and second elongated metal tubes are each non-removably attached to one end of said metal cable by passing an end of said cable into said tube and then crimping said tube down onto said cable end.

17. The combination of claim 15 wherein said metal cable is in the range of about 18 to 20 inches long and is about ⅛ inch in diameter, wherein said metal cable includes a protective plastic covering, and wherein the metal tubes are in the range of about 6 inches long, and have about a ¼ inch outer diameter and about a 1/16 inch wall thickness.

18. The combination of claim 15 wherein said ladder is a metal ladder having hollow rungs, and wherein said aligned openings in said side rails comprises a ladder rung.

19. Ladder safety apparatus for use in stabilizing the position of a generally straight ladder as the ladder leans against an object such as a building or the like, the apparatus comprising;

first and second terminal means, intermediary elongated connecting means having said terminal means secured to respective ends thereof with said intermediary means having a length for surrounding at least a portion of the ladder and with said terminal means movable into a direction generally towards the object against which the ladder is leaning, and first and second attachment means each adapted to securely grip a portion of the object against which the ladder is leaning, said attachment means being selectively movable relative to said first and second terminal means, respectively, to thereby facilitate adjustment of the effective length of the combination of said terminal means and said intermediary means as said intermediary means surrounds said ladder portion, and as said first and second attachment means secure the two ends of said cable means to the object against which the ladder is leaning.

20. Apparatus in accordance with claim 18 wherein said intermediary means is a flexible cable, and said first and second attachment means are hooks configured to grip ridge defining elements of the object against which the ladder is leaning.

21. Apparatus in accordance with claim 19 for use with a ladder that has hollow rungs each defining an opening through the length of the ladder between the side rails thereof, said flexible cable intermediary means and at least one of said terminal means each having a diameter for passing through said hollow rungs, said flexible cable further having a length for allowing flexure of both said terminal ends in a direction towards the object against which the ladder is leaning when said flexible cable passes through one of the rungs.

* * * * *